US007783232B2

(12) United States Patent
Minami et al.

(10) Patent No.: US 7,783,232 B2
(45) Date of Patent: Aug. 24, 2010

(54) DEVELOPING DEVICE, IMAGE FORMING APPARATUS AND METHOD FOR FILLING DEVELOPER

(75) Inventors: Megumi Minami, Amagasaki (JP); Tomohiro Kato, Okazaki (JP); Junji Murauchi, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 30 days.

(21) Appl. No.: 12/337,806

(22) Filed: Dec. 18, 2008

(65) Prior Publication Data

US 2009/0245879 A1 Oct. 1, 2009

(30) Foreign Application Priority Data

Mar. 28, 2008 (JP) ..... 2008-085699

(51) Int. Cl.
*G03G 15/08* (2006.01)

(52) U.S. Cl. ..... 399/255; 399/257; 399/258

(58) Field of Classification Search ..... 399/254–258, 399/260, 262

See application file for complete search history.

(56) References Cited

U.S. PATENT DOCUMENTS 6,526,252 B1 * 2/2003 Itoh et al. ..... 399/359
6,711,375 B1 * 3/2004 Itoh ..... 399/359

FOREIGN PATENT DOCUMENTS

| | | |
|---|---|---|
| JP | 59-100471 A | 6/1984 |
| JP | 11-167269 | 6/1999 |
| JP | 2006-221013 | 8/2006 |
| JP | 2007-078757 | 3/2007 |

OTHER PUBLICATIONS

Notification of Reason for Refusal issued in corresponding Japanese Patent Application No. 2008-085699, mailed Feb. 23, 2010 and English translation thereof.

A Decision of Refusal issued in corresponding Japanese Patent Application No. 2008-085699, mailed Jun. 29, 2010, and English translation thereof.

* cited by examiner

*Primary Examiner*—Hoang Ngo
(74) *Attorney, Agent, or Firm*—Buchanan Ingersoll & Rooney PC

(57) ABSTRACT

In a trickle developing device that uses a two-component developer, a simple configuration is adopted to prevent carrier from being discharged without being used. The developing device having stirring members for conveying and stirring developer and a developer holder, comprises a developer replenishing tank for replenishing developer to a developer tank and a trickle discharging mechanism, wherein the initial filling amount of the developer-tank-contained developer to be filled initially into the developer tank is less than a full filling amount.

11 Claims, 4 Drawing Sheets

DEVELOPING DEVICE, IMAGE FORMING APPARATUS AND METHOD FOR FILLING DEVELOPER

This application is based on applications No. 2008-85699 filed in Japan, the contents of which are hereby incorporated by reference.

BACKGROUND OF THE INVENTION

1. Field of the Invention

The present invention relates to a developing device for use in an electrophotographic image forming apparatus, to an image forming apparatus and to a method for filling developer. More particularly, the present invention relates to a trickle developing device that gradually supplies fresh developer and gradually discharge deteriorated developer, to an image forming apparatus incorporating the developing device and to a method for filling developer for use in the developing device.

2. Description of the Related Art

As developing systems employed for electrophotographic image forming apparatuses, the one-component developing system in which toner is used as the main component of the developer and the two-component developing system in which toner and carrier are used as the main components of the developer are known.

The two-component developing system that uses toner and carrier, in which the toner and carrier are charged by friction contact therebetween to predetermined polarities, has a characteristic that the stress on the toner is less than that in the one-component developing system that uses a one-component developer. Since the surface area of the carrier is larger than that of the toner, the carrier is less contaminated with the toner attached to the surface thereof. However, with the use for a long period, contamination (spent) attached to the surface of the carrier increases, whereby the capability of charging the toner is reduced gradually. As a result, problems of photographic fog and toner scattering occur. Although it is conceivable that the amount of the carrier stored in a two-component developing device is increased to extend the life of the developing device, this is undesirable because the developing device becomes larger in size.

To solve the problems encountered in the two-component developer, Patent document 1 discloses a trickle developing device being characterized in that fresh developer is gradually replenished into the developing device and developer deteriorated in charging capability is gradually discharged from the developing device, whereby the increase of the deteriorated carrier is suppressed. The developing device is configured to maintain the volume level of the developer inside the developing device approximately constant by discharging an excessive amount of deteriorated developer using the change in the volume of the developer. In the trickle developing device, the deteriorated carrier inside the developing device is gradually replaced with fresh carrier, and the charging performance of the carrier inside the developing device can be maintained approximately constant.

However, in a trickle developing device that uses a two-component developer, fresh developer is replenished from a replenishing tank and the developer existing inside the developing device is discharged from a discharge port to maintain the state in which the developer contained inside the developing device exists in a predetermined amount. Since the developer discharged from the discharge port contains unused carrier together with deteriorated carrier, there occurs a problem that the fresh carrier having been replenished intentionally is wasted. Accordingly, an image forming apparatus as disclosed in Patent document 2 is proposed to prevent replenished fresh developer from being discharged without being used.

In other words, the image forming apparatus according to Patent document 2 is characterized in that developer discharge operation is not carried out but circulation operation is carried out until the developer inside a first stirring and conveying chamber reaches a predetermined amount, and that when the developer having reached the predetermined amount is detected using a sensor, a lid having closed the discharge port of the first stirring and conveying chamber is opened and a shutter having closed the discharge port of the supplying and conveying chamber is opened, and newly replenished developer is circulated and stirred, whereby the newly replenished developer is prevented from being discharged directly.

[Patent document 1] Japanese Patent Application Laid-Open Publication No. Sho 59-100471

[Patent document 2] Japanese Patent Application Laid-Open Publication No. 2007-078757

In the image forming apparatus disclosed in Patent document 2, replenished fresh developer is discharged after circulated and stirred; since the shutter for discharging developer is configured so as to be driven using a shutter opening/closing motor on the basis of signals from a controller, there occurs a problem that the discharge control configuration for controlling the discharge of the developer is complicated and high in cost.

Accordingly, the technical problem to be solved by the present invention is to provide a developing device, an image forming apparatus and a method for filling developer capable of preventing carrier from being discharged without being used by using a simple configuration in a trickle developing device that uses a two-component developer.

SUMMARY OF THE INVENTION

To solve the above-mentioned technical problem, the present invention provides:

a method for filling developer into the developer tank of a developing device comprising stirring members for stirring a developer-tank-contained developer containing toner and carrier while conveying the developer along conveying passages inside the developer tank, a developer holder disposed adjacent to the stirring members to supply the stirred developer-tank-contained developer to an electrostatic latent image holder, a developer replenishing tank for replenishing a replenishment developer containing toner and carrier to the developer tank, and a discharging mechanism for discharging an excessive amount of the developer-tank-contained developer outside the developer tank from a discharge opening section when the amount of the developer-tank-contained developer conveyed using the stirring members inside the developer tank exceeds a predetermined amount, the method being basically characterized in that the initial filling amount of the developer-tank-contained developer to be filled initially into the developer tank is set so as to be less than the above-mentioned full filling amount.

Furthermore, the present invention provides:

a developing device having stirring members for stirring a developer-tank-contained developer containing toner and carrier while conveying the developer along conveying passages inside a developer tank and a developer holder disposed adjacent to the stirring members to supply the stirred developer-tank-contained developer to an electrostatic latent image holder, comprising:

a developer replenishing tank for replenishing a replenishment developer containing toner and carrier to the developer tank, and a discharging mechanism for discharging an excessive amount of the developer-tank-contained developer outside the developer tank from a discharge opening section when the amount of the developer-tank-contained developer conveyed using the stirring members inside the developer tank exceeds a predetermined full filling amount, the device being characterized in that the initial filling amount of the developer-tank-contained developer to be filled initially into the developer tank is set so as to be less than the above-mentioned full filling amount.

When a developing device having the so-called trickle discharging mechanism is in an ordinary operation state, the developer-tank-contained developer is discharged using the trickle discharging mechanism, and replenishing operation for replenishing fresh developer from the developer replenishing tank is carried out; as a result, a full filling state is attained in which the inside of the developer tank is filled with a full filling amount of the developer-tank-contained developer such that the supply amount of the developer is substantially equal to the discharge amount. In an initial stage until this full filling state is reached, the initial filling amount of the developer-tank-contained developer to be filled initially into the developer tank is set so as to be less than the full filling amount in advance, whereby the replenished replenishment developer is accommodated inside the developer tank. Hence, the carrier contained in the replenished replenishment developer can be prevented from being discharged without being used. Furthermore, since it is not necessary to separately provide a discharge control mechanism or the like for controlling the discharge of the developer-tank-contained developer, no new cost is generated.

The developing device eventually reaches the full filling state by operating the image forming apparatus. In order to further reduce the discharge amount of the carrier when the discharge operation is carried out after the full filling state is reached, it is preferable that the amount of the carrier contained in the initial developer-tank-contained developer should be less than the amount of the carrier contained in the developer-tank-contained developer at the time of the full filling state.

In the case that the initial filling amount of the developer-tank-contained developer is set excessively small, improper image formation, such as uneven image concentration, occurs. Hence, the initial filling amount is set so as to be larger than an amount just prior to the limit filling amount at which improper image formation occurs because of the shortage of the developer-tank-contained developer.

When the image forming operation is carried out, the toner inside the developer tank is consumed, and the toner concentration becomes lower gradually. As the toner is consumed, a predetermined amount of toner is replenished from the developer replenishing tank; however, since the replenishment of the toner is carried out by carrying out the replenishment of the replenishment developer containing toner and carrier, the replenishment of the carrier is also carried out, accompanied by the replenishment of the toner. Since the amount of the replenished carrier is added to the amount of the carrier that exists initially, the amount of the carrier existing inside the developer tank increases gradually. Hence, there is a possibility that the carrier is discharged without being used. In addition, in an initial stage in which not a long time has passed after the developing device was operated, the carrier is not deteriorated so much, and it is not necessary to replace a large amount of the carrier. In order to avoid the carrier from being discharged in an unused state, the ratio of the carrier contained in the replenishment developer that is filled first time into the developer replenishing tank is set so as to be lower than the ratio of the carrier contained in the replenishment developer that is filled after the first time.

As described above, in the initial stage and an ordinary operation stage in which ordinary image forming operation is carried out after a certain time has passed after the initial stage, multiple kinds of the developer replenishing tank, being different in the ratio of the carrier contained in the replenishment developer 2, are used occasionally. There is a possibility that a developer replenishing tank different from the developer replenishing tank that should be mounted essentially is mounted on the developing device by mistake while the operation stage is shifted between the initial stage and the ordinary operation stage, whereby it is necessary to prevent the developer replenishing tank from being mounted improperly. In order that the device can judge what ratio of the carrier the developer replenishing tank to be mounted has, it is preferable that the developer replenishing tank is configured so as to be attachable and detachable to and from the developing device and is equipped with an information storage medium that stores information regarding the ratio of the carrier contained in the replenishment developer filled in the developer replenishing tank.

The above-mentioned developing device is incorporated and used in an image forming apparatus having a rotatable electrostatic latent image holder for holding electrostatic latent images on the circumferential face thereof.

DESCRIPTION OF THE PREFERRED EMBODIMENT

Figure 1:
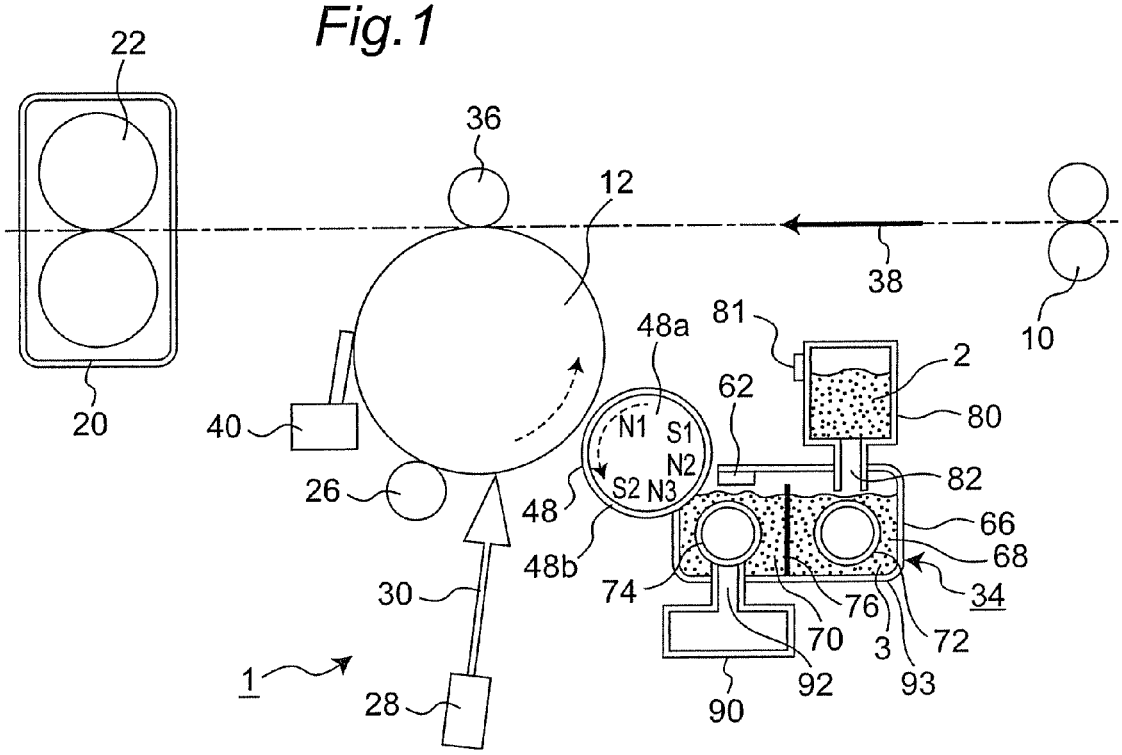
FIG. 1 is a view showing the schematic configuration of an image forming apparatus according to a first embodiment of the present invention.

Preferred embodiments according to the present invention will be described below referring to the accompanying drawings. Although terms meaning specific directions (for example, "above," "below," "left" and "right" and other terms including these, and "clockwise" and "counterclockwise") are used in the following description, they are used for purposes of facilitating the understanding of the present invention referring to the drawings, and it should not be construed that the present invention is limited by the meanings of the terms. Furthermore, in an image forming apparatus 1 and a developing device 34 described below, identical or similar components are designated by the same reference numerals.

The image forming apparatus 1 according to a first embodiment of the present invention and the developing device 34 incorporated in the image forming apparatus 1 will be described referring to FIGS. 1 to 3.

[Image Forming Apparatus]

FIG. 1 shows the components relating to image formation in the electrophotographic image forming apparatus 1 according to the present invention. The image forming apparatus 1 may be a copier, a printer, a facsimile machine or a compound machine combinedly equipped with the functions of these. The image forming apparatus 1 has a photosensitive member 12 serving as an electrostatic latent image holder. Although the photosensitive member 12 is formed of a cylinder in this embodiment, the photosensitive member 12 is not limited to have such a shape in the present invention, but it is possible to use an endless belt-type photosensitive member instead. The photosensitive member 12 is connected to a motor (not shown) so as to be driven and is rotated on the basis of the driving of the motor in the direction indicated by the arrow. Around the circumference of the photosensitive member 12, a charging device 26, an exposure device 28, a developing device 34, a transfer device 36 and a cleaning device 40 are respectively arranged along the rotation direction of the photosensitive member 12.

The charging device 26 charges the photosensitive layer, that is, the outer circumferential face of the photosensitive member 12, to a predetermined potential. Although the charging device 26 is represented as a cylindrical roller in this embodiment, instead of this, it is also possible to use charging devices of other forms (for example, a rotary or fixed brush type charging device and a wire discharging type charging device). The exposure device 28 disposed at a position close to or away from the photosensitive member 12 emits image light 30 toward the outer circumferential face of the charged photosensitive member 12. An electrostatic latent image having an area wherein the image light 30 is projected and the charged potential is attenuated and an area wherein the charged potential is almost maintained is formed on the outer circumferential face of the photosensitive member 12 that has passed the exposure device 28. In this embodiment, the area wherein the charged potential is attenuated is the image area of the electrostatic latent image, and the area wherein the charged potential is almost maintained is the non-image area of the electrostatic latent image. The developing device 34 develops the electrostatic latent image into a visible image using a developer-tank-contained developer 3 described later. The details of the developing device 34 are described later. The transfer device 36 transfers the visible image formed on the outer circumferential face of the photosensitive member 12 onto paper 38 or film. Although the transfer device 36 is shown as a cylindrical roller in the embodiment shown in FIG. 1, it is also possible to use transfer devices having other forms (for example, a wire discharging type transfer device). The cleaning device 40 recovers non-transferred toner not transferred to the paper 38 by the transfer device 36 but remaining on the outer circumferential face of the photosensitive member 12 from the outer circumferential face of the photosensitive member 12. Although the cleaning device 40 is shown as a plate-like blade in this embodiment, instead of this, it is also possible to use cleaning devices having other forms (for example, a rotary or fixed brush-type cleaning device).

When the image forming apparatus 1 configured as described above forms an image, the photosensitive member 12 is rotated counterclockwise, for example, on the basis of the driving of the motor (not shown). At this time, the outer circumferential area of the photosensitive member 12 passing the charging device 26 is charged to a predetermined potential at the charging device 26. The outer circumferential area of the charged photosensitive member 12 is exposed to the image light 30 at the exposure device 28, and an electrostatic latent image is formed. As the photosensitive member 12 is rotated, the electrostatic latent image is conveyed to the developing device 34 and developed into a visible image using the developing device 34. As the photosensitive member 12 is rotated, the toner image developed into the visible image is conveyed to the transfer device 36 and transferred to the paper 38 using the transfer device 36. The paper 38 to which the toner image is transferred is conveyed to a fixing device 20, and the toner image is fixed to the paper 38. The outer circumferential area of the photosensitive member 12 having passed the transfer device 36 is conveyed to the cleaning device 40 in which the toner not transferred to the paper 38 but remaining on the outer circumferential face of the photosensitive member 12 is scraped off from the photosensitive member 12.

[Developing Device]

The developing device 34 is provided with a two-component developer containing non-magnetic toner (hereafter simply referred to as toner) and magnetic carrier (hereafter simply referred to as carrier) and a developer tank 66 accommodating various members. The developer tank 66 has an opening section being open toward the photosensitive member 12, and a developing roller 48 is installed in a space formed near the opening section. The developing roller 48 serving as a developer holder is a cylindrical member that is rotatably supported in parallel with the photosensitive member 12 while having a predetermined developing gap to the outer circumferential face of the photosensitive member 12.

The developing roller 48 is the so-called magnetic roller having a magnet 48*a* secured so as not to be rotatable and a cylindrical sleeve 48*b* (first rotating cylinder) supported so as to be rotatable around the circumference of the magnet 48*a*. Above the sleeve 48*b* of the developing roller 48, a regulating plate 62 secured to the developer tank 66 and extending in parallel with the center axis of the sleeve 48*b* of the developing roller 48 is disposed so as to be opposed thereto with a predetermined regulating gap therebetween. The magnet 48*a* disposed inside the developing roller 48 has five magnetic poles N1, S2, N3, N2 and S1 in the rotation direction of the sleeve 48*b*. Among these magnetic poles, the main magnetic pole N1 is disposed so as to be opposed to the photosensitive member 12. The magnetic poles N2 and N3 having the same polarity and generating a repulsive magnetic field for detaching the developer from the surface of the sleeve 48*b* are disposed so as to be opposed to each other inside the developer tank 66. The sleeve 48*b* of the developing roller 48 rotates in the direction opposite to the rotation direction of the photosensitive member 1 (counter direction).

Figure 2:
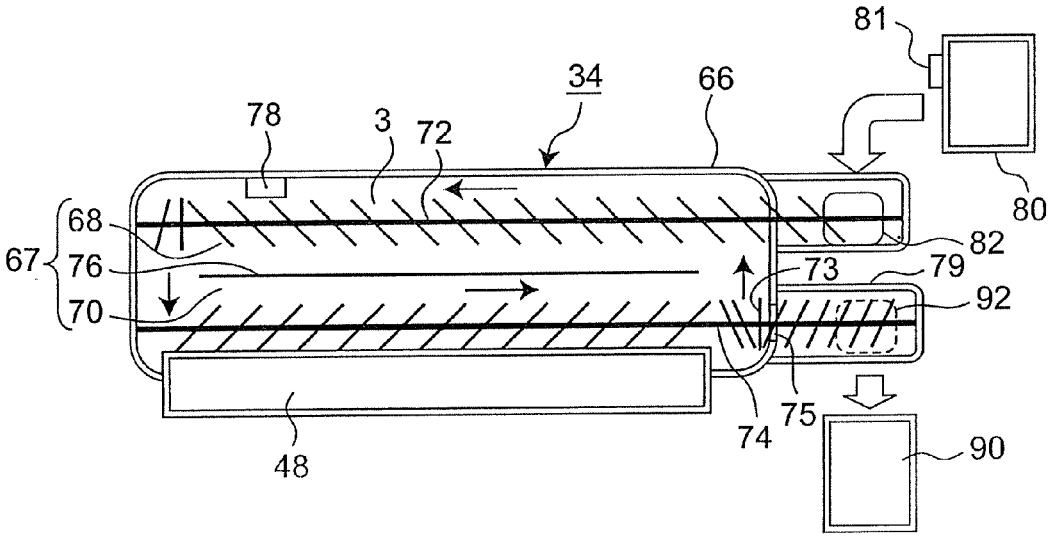
FIG. 2 is a schematic sectional view showing the developing device of the image forming apparatus shown in FIG. 1 as seen from above.

FIG. 2 is a schematic sectional view showing the developing device 34 as seen from above. As shown in FIG. 2, a developer stirring and conveying chamber 67 is formed behind the developing roller 48. The developer stirring and conveying chamber 67 comprises a second conveying passage 70 formed near the developing roller 48, a first conveying passage 68 formed away from the developing roller 48 and a partition wall 76 for partitioning the space between the first conveying passage 68 and the second conveying passage 70. Above the upstream side in the conveying direction of the first conveying passage 68, a developer replenishing tank 80 is disposed, and the developer replenishing tank 80 communicates with the first conveying passage 68 via a replenishing port 82. The developer replenishing tank 80 is filled with a replenishment developer 2 containing toner as a major ingredient and carrier. The ratio of the carrier in the replenishment developer 2 is preferably 5 to 40 wt %, further preferably 10 to 30 wt %. In addition, below the downstream side in the conveying direction of the second conveying passage 70, a developer recovery tank 90 is disposed, and the second conveying passage 70 communicates with the developer recovery tank 90 via a recovery port 92.

At the bottom of the developer replenishing tank 80, a developer supplying roller is disposed, the driving operation of which is controlled using a controller 100. When the developer supplying roller is driven and rotated, the replenishment developer 2, which is fresh and the amount of which corresponds to the driving time of the roller, flows downward and is supplied to the first conveying passage 68 of the developer tank 66.

In the first conveying passage 68, a first screw 72 serving as a stirring member for conveying the developer-tank-contained developer 3 while stirring the developer is rotatably supported. In the second conveying passage 70, a second screw 74 for conveying the developer-tank-contained developer 3 from the first conveying passage 68 to the developing roller 48 while stirring the developer is rotatably supported. In this case, the upper portions of the partition wall 76, located at both end sections of the second conveying passage 70 and the first conveying passage 68, are cut out, and communicating passages are formed. In other words, in FIG. 2, a first communicating passage 71 for connecting the downstream side of the second conveying passage 70 to the upstream side of the first conveying passage 68 is formed on the right side of the partition wall 76, and a second conveying passage 69 for connecting the downstream side of the first conveying passage 68 to the upstream side of the second conveying passage 70 is formed on the left side of the partition wall 76. As a result, a circulation passage through which the developer-tank-contained developer 3 circulates is formed using the second conveying passage 70, the first communicating passage 71, the first conveying passage 68 and the second communicating passage 69. The developer-tank-contained developer 3 circulates inside the developer stirring and conveying chamber counterclockwise in the direction indicated by the arrow shown in FIG. 2, for example.

The first screw 72 and the second screw 74 are each a spiral screw in which a spiral vane with a predetermined pitch is secured to a shaft. As shown in FIG. 2, the second screw 74 extends rightward in the figure and further extends above the recovery port 92.

The second screw 74 has a conveying forward screw section extending to the second conveying passage 70 and a discharging forward screw section extending to the developer discharging section 79 positioned at the downstream side end section (the right end section in FIG. 2) in the conveying direction. The conveying forward screw section conveys the developer-tank-contained developer existing inside the developer tank 66 to the developer discharging section 79. The discharging forward screw section conveys the developer existing inside the developer discharging section 79 to the recovery port 92.

In addition, at each of the positions corresponding to the first communicating passage 71 extending from the second conveying passage 70 to the first conveying passage 68 and corresponding to the downstream side end section of the first conveying passage 68, the second screw 74 has a reverse screw section in which the spiral direction of the spiral screw is opposite to that at the other section. A stopping member 73 is provided on the side of the developer discharging section 79 of the reverse screw section 77. The stopping member 73 is a nearly disc-shaped member extending in the direction orthogonal to the rotation shaft of the second screw 74 and has an action of restricting the rising of the developer-tank-contained developer 3 formed using the reverse screw section from moving to the side of the developer discharging section 79.

When the second screw 74 rotates, a reverse flow for moving the developer-tank-contained developer 3 from the developer discharging section 79 to the second conveying passage 70 is generated using the reverse screw section. As a result, when the second screw 74 rotates, the level of the developer-tank-contained developer 3 at the downstream side end section (the right end section) in the conveying direction of the second screw 74 becomes higher than that at the other section. In other words, a rising of the developer-tank-contained developer 3 is formed at the downstream side end section (the right end section) in the conveying direction of the second conveying passage 70, that is, the reverse screw section. Furthermore, the stopping member 73 restricts the rising of the developer-tank-contained developer 3 from moving to the side of the developer discharging section 79.

Since the developing device 34 employs the so-called trickle system, the developing device has a flow outlet 75 for allowing an excessive amount of the developer-tank-contained developer 3 to flow out. In other words, a cutout 75 is provided as the flow outlet 75 that is formed by partially cutting out the upper portion of the side wall located at the downstream side end section (the right end section) in the conveying direction of the second conveying passage 70. In a usual state, the developer being conveyed using the second screw 74 is stopped using the reverse screw section and the stopping member 73 and conveyed from the second conveying passage 70 to the first conveying passage 68 via the first communicating passage 71 as indicated by the solid-line arrows shown in FIG. 2. When the developer-tank-contained developer 3 increases inside the developer tank and the developer level inside the developer tank rises, the developer-tank-contained developer 3 climbs over the flow outlet 75 provided at the upper portion of the side wall against the stopping action of the reverse screw section and the stopping member 73 and overflows to the developer discharging section 79 adjacent thereto. The excessive amount of the developer-tank-contained developer 3 overflowed to the developer discharging section 79 is conveyed to the recovery port 92 and recovered (dumped) into the developer recovery tank 90 via the recovery port 92.

As shown in FIG. 2, in the developer stirring and conveying chamber 67, a toner concentration detecting sensor 78 for detecting the toner concentration inside the developer stirring and conveying chamber 67 is provided. The toner concentration detecting sensor 78 detects the permeability of the developer-tank-contained developer 3 being conveyed inside the developer stirring and conveying chamber 67 on the basis of the change in the inductance of a coil, for example. The ratio of the toner in the developer-tank-contained developer 3 is obtained on the basis of the permeability detected using the toner concentration detecting sensor 78. For example, when the amount of the carrier contained in the developer-tank-contained developer 3 is small, it is detected that the ratio of the toner is high. On the other hand, when the amount of the carrier contained in the developer-tank-contained developer 3 is large, it is detected that the ratio of the toner is low. In addition, the voltage signal output from the toner concentration detecting sensor 78 is input to the controller 100, a required replenishing amount is calculated on the basis of the detection signal, the developer replenishing roller of the developer replenishing tank 80 is driven, and the predetermined amount of the replenishment developer 2 is replenished into the developer tank 66.

In the developing device 34, when the toner concentration of the circulating developer-tank-contained developer 3 lowers as the image formation operation proceeds, the replenishment developer 2 containing toner and a small amount of carrier is replenished from the developer replenishing tank 80. The replenishment developer 2 having been replenished is conveyed along the first conveying passage 68 and the second conveying passage 70 of the above-mentioned developer stirring and conveying chamber 67 while being mixed and stirred with the developer-tank-contained developer 3 already existing therein. Although the toner is basically consumed on the photosensitive member 12, the carrier is accumulated inside the developing device 34, and the charging performance of the carrier lowers gradually. Since a small amount of the carrier that is bulkier than the toner is contained in the replenishment developer 2, as the replenishment developer 2 is replenished, the amount of the developer-tank-contained developer 3 gradually increases inside the developing device 34. Then, the developer-tank-contained developer 3 having increased in volume circulates in the developer stirring and conveying chamber 67. An excessive amount of the developer-tank-contained developer 3 being unable to circulate in the developer stirring and conveying chamber 67 climbs over the reverse screw section and flows out from the flow outlet 75 provided at the downstream side end section (the right end section) in the conveying direction of the second conveying passage 70 and is recovered in the developer recovery tank 90 via the recovery port 92.

The replenishing amount of the replenishment developer 2 is determined on the basis of the toner concentration of the developer-tank-contained developer 3 detected using the toner concentration detecting sensor 78, the image information (dot counter) at the time of image formation and the ratio of the carrier in the replenishment developer 2 inside the developer replenishing tank 80. The ratio of the carrier in the replenishment developer 2 inside the developer replenishing tank 80 is adjusted to the extent that the carrier inside the developing device 34 is suppressed from deteriorating and that the cost is not increased. As the toner replenishing operation proceeds, the carrier is supplied gradually.

As described later, the developer replenishing tank 80 is configured so as to be attachable and detachable to and from the developing device 34, and multiple kinds of the developer replenishing tank 80, being different in the ratio of the carrier contained in the replenishment developer 2, are mounted on the developing device 34 occasionally. In order to prevent a developer replenishing tank 80 different from the desired developer replenishing tank 80 being mounted on the developing device 34 by mistake, it is preferable that the configuration is formed so that the device can judge what ratio of the carrier the developer replenishing tank 80 to be mounted has. Hence, the developer replenishing tank 80 is equipped with an information storage memory (for example, an IC chip or IC tag) that stores information regarding the ratio of the carrier contained in the replenishment developer 2 filled in the developer replenishing tank 80.

Figure 3:
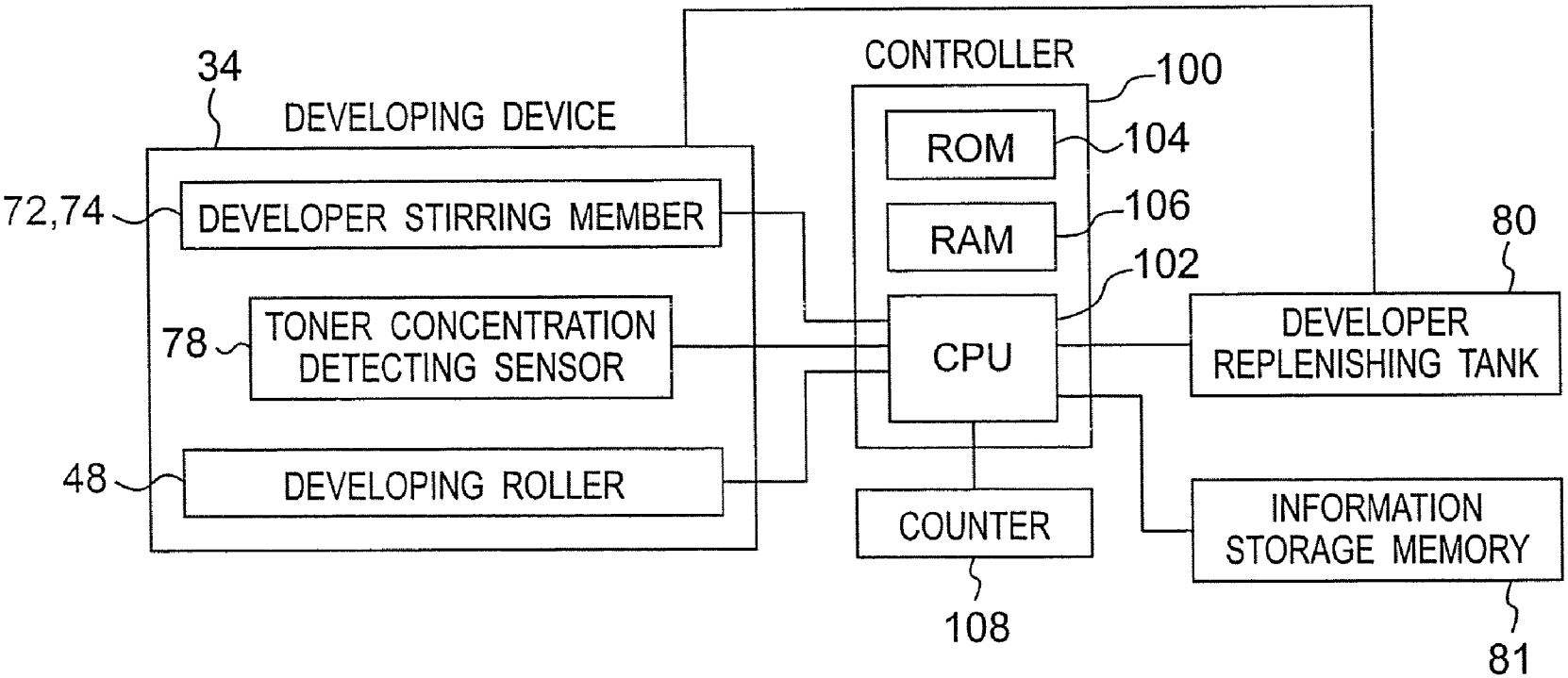
FIG. 3 is a block diagram of the developing device of the image forming apparatus shown in FIG. 2.

FIG. 3 is a control block diagram of the developing device 34 of the image forming apparatus 1.

The controller 100 serving as controlling means comprises a CPU (central processing unit) 102, a ROM (read only memory) 104, a RAM (random access memory) 106, etc. The CPU 102 concentratedly controls various operations in the image forming apparatus 1 according to various processing programs and tables stored inside the ROM 104. In the ROM 104, for example, a toner concentration calculation table for carrying out calculation to convert the voltage detected using the toner concentration detecting sensor 78 into the toner concentration of the developer-tank-contained developer 3 and a developer replenishing table for calculating the amount of the developer to be replenished on the basis of the difference between the actual toner concentration of the developer-tank-contained developer 3 and the reference toner concentration are stored. The RAM 106 provides a work area in which various programs to be executed by the controller 100 and data for the programs are temporarily stored.

The developing device 34, the developer replenishing tank 80 and a counter 108 are connected to the controller 100. The operations of the developer stirring members 72 and 74, the toner concentration detecting sensor 78 and the developing roller 48 constituting the developing device 34 are controlled using the CPU 102 of the controller 100. In addition, the toner concentration of the developer-tank-contained developer 3 detected using the toner concentration detecting sensor 78, image information at the time of image formation, the ratio of the carrier in the replenishment developer 2 inside the developer replenishing tank 80, etc. are temporarily stored in the RAM 106.

Furthermore, the information stored in an information storage memory 81 installed on the developer replenishing tank 80 is read by the CPU 102 of the controller 100 via a reading interface. It can be configured such that when the CPU 102 of the controller 100 judges that a developer replenishing tank 80 different from the developer replenishing tank 80 that should be mounted essentially has been mounted, the user is alerted to improper mounting of the developer replenishing tank 80 by alarming means, such as a buzzer or speaker, for generating sound or artificial voice to call attention or displaying means for displaying messages to call attention.

[Developer]

The two-component developer contains toner and carrier for charging the toner. In the present invention, the known toner that has been used generally and conventionally can be used for the image forming apparatus 1. The particle diameter of the toner is, for example, approximately 3 to 15 μm. It is also possible to use toner containing a coloring agent in a binder resin, toner containing a charge control agent and a releasing agent, and toner holding additives on the surface.

The toner is produced using known methods, such as the grinding method, the emulsion polymerization method and the suspension polymerization method.

Examples of the binder resin being used for the toner include styrene resins (homopolymers or copolymers containing styrene or styrene substitutes), polyester resins, epoxy resins, polyvinyl chloride resins, phenol resins, polyethylene resins, polypropylene resins, polyurethane resins, silicone resins or any appropriate combinations of these resins, although not restricted to these. The softening temperature of the binder resin is preferably in the range of approximately 80 to 160° C., and the glass transition temperature thereof is preferably in the range of approximately 50 to 75° C.

As the coloring agent, it is possible to use known materials, such as carbon black, aniline black, activated charcoal, magnetite, benzine yellow, permanent yellow, naphthol yellow, phthalocyanine blue, fast sky blue, ultramarine blue, rose bengal and lake red. In general, the additive amount of the coloring agent is preferably 2 to 20 parts by weight per 100 parts by weight of the binder resin.

The materials conventionally known as charge control agents can be used as the charging control agent. More specifically, for the toner that is positively charged, it is possible to use materials, such as nigrosin dyes, quaternary ammonium salt compounds, triphenylmethane compounds, imidazole compounds and polyamine resins, as the charge control agent. For the toner that is negatively charged, it is possible to use materials, such as azo dyes containing metals such as Cr, Co, Al and Fe, salicylic acid metal compounds, alkyl salicylic acid metal compounds and calixarene compounds, as the charge control agent. It is desirable that the charge control agent is used in the ratio of 0.1 to 10 parts by weight per 100 parts by weight of the binder resin.

The materials conventionally known and used as releasing agents can be used as the releasing agent. As the material of the releasing agent, it is possible to use materials, such as polyethylene, polypropylene, carnauba wax, sasol wax or any appropriate combinations of these. It is desirable that the releasing agent is used in the ratio of 0.1 to 10 parts by weight per 100 parts by weight of the binder resin.

Furthermore, it may be possible to add a fluidizer for accelerating the fluidization of the developer. As the fluidizer, it is possible to use inorganic particles, such as silica, titanium oxide and aluminum oxide, and resin particles, such as acrylic resins, styrene resins, silicone resins and fluororesins. It is particularly desirable to use materials hydrophobized using a silane coupling agent, a titanium coupling agent, silicone oil, etc. It is desirable that the fluidizer is added in the ratio of 0.1 to 5 parts by weight per 100 parts by weight of the toner. It is desirable that the number average primary particle diameters of these additives are in the range of 9 to 100 nm.

As the carrier, the known carriers used conventionally and generally can be used. Either the binder-type carrier or the coated-type carrier may be used. It is desirable that the diameter of the carrier particles is in the range of approximately 15 to 100 μm, although not restricted to this range.

The binder-type carrier is that obtained by dispersing magnetic particles in a binder resin and it is possible to use carrier having positively or negatively charged particles or a coating layer on its surface. The charging characteristics, such as polarity, of the binder-type carrier can be controlled depending on the material of the binder resin, electrostatic charging particles and the kind of the surface coating layer.

Examples of the binder resin being used for the binder-type carrier include thermoplastic resins, such as vinyl resins typified by polystyrene resins, polyester resins, nylon resins and polyolefin resins, and thermosetting resins, such as phenol resins.

As the magnetic particles of the binder-type carrier, it is possible to use spinel ferrites, such as magnetite and gamma ferric oxide; spinel ferrites containing one or more kinds of nonferrous metals (such as Mn, Ni, Mg and Cu); magnetoplumbite ferrites, such as barium ferrite; and iron or alloy particles having oxide layers on the surfaces. The shape of the carrier may be particulate, spherical or needle-like. In particular, when high magnetization is required, it is desirable to use iron-based ferromagnetic particles. In consideration of chemical stability, it is desirable to use ferromagnetic particles of spinel ferrites, such as magnetite and gamma ferric oxide, or magnetoplumbite ferrites, such as barium ferrite. It is possible to obtain magnetic resin carrier having the desired magnetization by appropriately selecting the kind and content of the ferromagnetic particles. It is appropriate to add 50 to 90 wt % of the magnetic particles to the magnetic resin carrier.

As the surface coating material of the binder-type carrier, it is possible to use silicone resins, acrylic resins, epoxy resins, fluororesins, etc. The charging capability of the carrier can be enhanced by coating the surface of the carrier with this kind of resin and by thermosetting the resin.

The fixation of electrostatic charging particles or electrically conductive particles to the surface of the binder-type carrier is carried out according to, for example, a method in which the magnetic resin carrier is uniformly mixed with the particles, the particles are attached to the surface of the magnetic resin carrier, and then mechanical and thermal impact forces are applied to the particles to put the particles into the magnetic resin carrier. In this case, the particles are not completely embedded into the magnetic resin carrier but fixed such that parts thereof protrude from the surface of the magnetic resin carrier. As the electrostatic charging particles, organic or inorganic insulating materials are used. More specifically, as organic insulating materials, organic insulating particles, such as polystyrene, styrene copolymers, acrylic resins, various acrylic copolymers, nylon, polyethylene, polypropylene, fluororesins and cross-linked materials of these are available. The charging capability and the charging polarity thereof can be adjusted so as to be suited for the material of the electrostatic charging particles, polymerization catalyst, surface treatment, etc. As the inorganic insulating material, negatively charged inorganic particles, such as silica and titanium dioxide, and positively charged inorganic particles, such as strontium titanate and alumina, are used.

The coated-type carrier is carrier obtained by coating carrier core particles made of a magnetic substance with a resin, and electrostatic charging particles charged positively or negatively can be fixed to the surface of the carrier, as in the case of the binder-type carrier. The charging characteristics, such as polarity, of the coated-type carrier can be adjusted by selecting the kind of the surface coating layer and the electrostatic charging particles. As the coating resin, it is possible to use resins similar to the binder resins for the binder-type carrier.

The mixture ratio of the toner and the carrier of the developer-tank-contained developer 3 is adjusted such that a desired toner charging amount is obtained. The ratio of the toner contained in the developer-tank-contained developer 3 is preferably 3 to 20 wt % and further preferably 4 to 15 wt % with respect to the total amount of the toner and the carrier. In addition, the replenishment developer 2 stored in the developer replenishing tank 80 contains toner and a small amount of carrier, and the ratio of the carrier contained in the replenishment developer 2 is preferably 1 to 50 wt % and further preferably 5 to 30 wt %.

The operation of the developing device 34 configured as described above will be described.

At the time of image formation, the sleeve 48*b* of the developing roller 48 is rotated in the direction indicated by the arrow (counterclockwise) on the basis of the driving of the motor (not shown). By the rotation of the first screw 72 and the rotation of the second screw 74, the developer-tank-contained developer 3 existing in the developer stirring and conveying chamber 67 is stirred while being circulated and conveyed through the first conveying passage 68, the first communicating passage 71, the second conveying passage 70 and the second communicating passage 69. As a result, the toner and the carrier contained in the developer make friction contact and are charged to have polarities opposite to each other. In this embodiment, it is assumed that the carrier is positively charged and that the toner is negatively charged. However, the charging characteristics of the toner and the carrier being used for the present invention are not limited to these combinations. The external size of the carrier is considerably larger than that of the toner. For this reason, the negatively charged toner is attached around the circumference of the positively charged carrier mainly on the basis of the electric attraction force exerted therebetween.

The developer-tank-contained developer 3 charged as described above is supplied to the developing roller 48 in the process of being conveyed to the second conveying passage 70 using the second screw 74. The developer is held on the surface of the sleeve 48*b* by the magnetic force of the magnet 48*a* inside the developing roller 48 and moved while being rotated counterclockwise together with the sleeve 48*b*, the throughput thereof is regulated using the regulating plate 62 disposed so as to be opposed to the developing roller 48, and then the developer is conveyed to the developing area opposed to the photosensitive member 12. Furthermore, in the developing area, chains of particles (magnetic brush) are formed by the magnetic force of the main magnet pole N1 of the magnet 48*a*. In the developing area, by the force of the electric field (electric field of AC superimposed on DC) that is formed between the electrostatic latent image on the photosensitive member 12 and the developing roller 48 to which a developing bias is applied and exerted to the toner, the toner is moved to the electrostatic latent image on the photosensitive member 12, and the electrostatic latent image is developed into a visible image. The developer, the toner of which is consumed in the developing area, is conveyed toward the developer tank 66, detached from the surface of the developing roller 48 by the repulsive magnetic field between the poles N3 and N2 of the magnet 48*a* disposed so as to be opposed to the second conveying passage 70 of the developer tank 66, and then recovered into the developer tank 66. The recovered developer is mixed with the developer-tank-contained developer 3 that is being conveyed to the second conveying passage 70.

When the toner contained in the developer-tank-contained developer 3 is consumed by the image formation described above, the amount of the toner corresponding to the consumed amount is replenished to the developer-tank-contained developer 3. For this purpose, the developing device 34 is equipped with the toner concentration detecting sensor 78 for measuring the ratio of the toner in the developer-tank-contained developer 3 existing in the developer stirring and conveying chamber 67. Furthermore, the developer replenishing tank 80 is provided above the first conveying passage 68.

Next, the relationship between the initial filling amount of the developer-tank-contained developer 3 and the discharge of the carrier in the developing device 34 according to the first embodiment of the present invention will be described referring to FIGS. 4 and 5.

Figure 4:
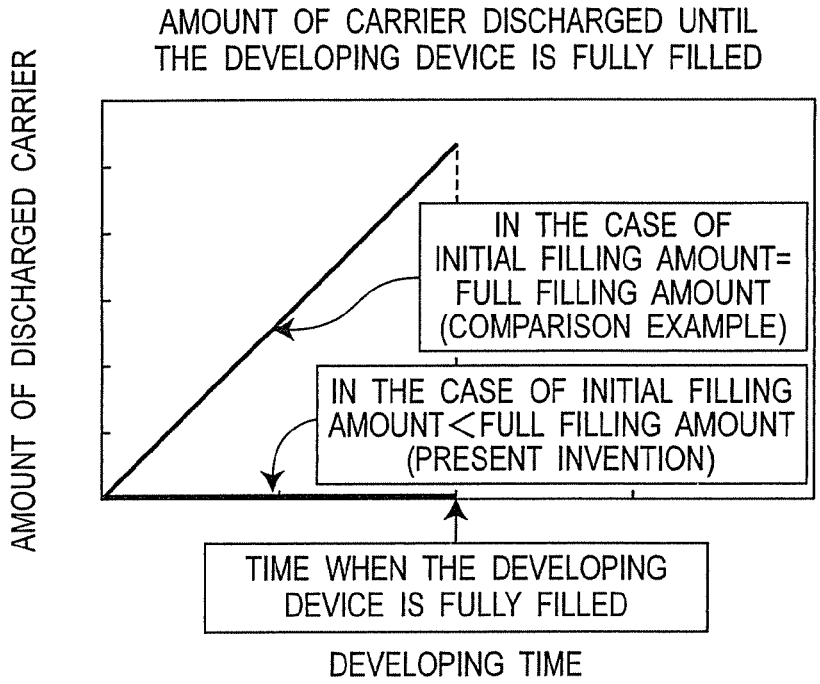
FIG. 4 is a schematic view illustrating the relationship between the magnitude relation of an initial filling amount with respect to a full filling amount and the amount of carrier to be discharged until the developing device is fully filled.

FIG. 4 is a schematic view illustrating how the discharge amount of the carrier discharged from the developing device 34 changes with the elapse of time in the case of the present invention in which the initial filling amount of the developer-tank-contained developer 3 is less than the full filling amount thereof and in the case of a comparison example in which the initial filling amount is equal to the full filling amount. FIG. 5 is a schematic view illustrating the total discharge amount of the carrier discharged after the developing operation was carried out for a certain developing time in the case of the comparison example in which the initial filling amount of the developer-tank-contained developer 3 is equal to the full filling amount and in the case of the present invention in which the initial filling amount is less than the full filling amount.

Figure 5:
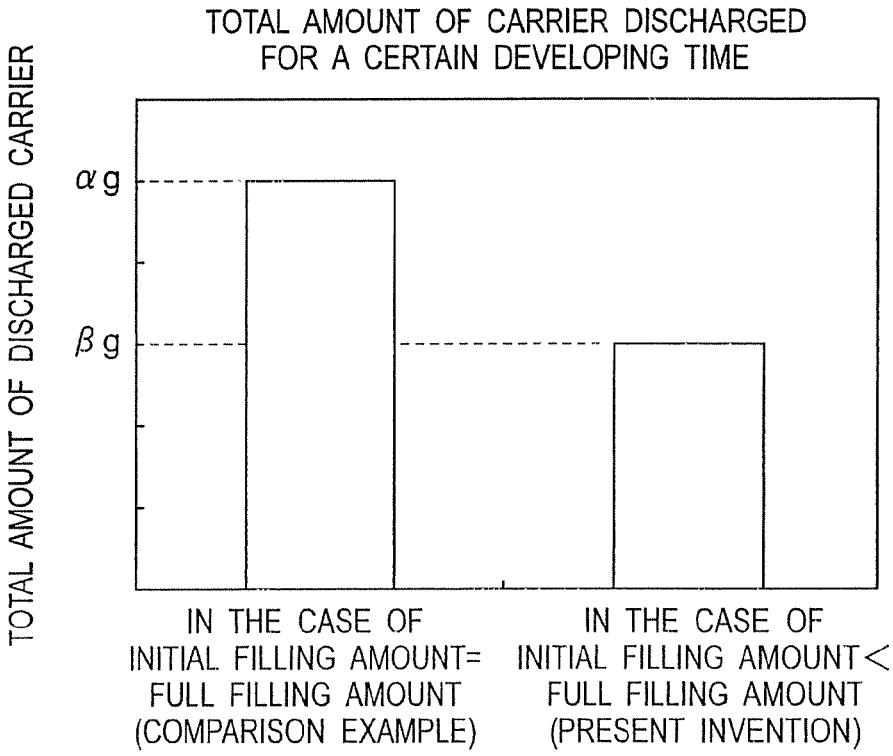
FIG. 5 is a schematic view illustrating the relationship between the magnitude relation of the initial filling amount with respect to the full filling amount and the amount of carrier discharged for a certain developing time.

In the developing device 34 according to the first embodiment of the present invention shown in FIGS. 4 and 5, the initial filling amount of the developer-tank-contained developer 3 that is filled initially into the developer tank 66 is less than the full filling amount. Furthermore, in the comparison example shown in FIGS. 4 and 5, the initial filling amount of the developer-tank-contained developer 3 that is filled initially into the developer tank 66 is equal to the full filling amount. In the present invention, the full filling amount is the filling amount obtained when the excessive amount of the developer-tank-contained developer 3 is in a state of being discharged outside the developer tank 66; in this state, the supply amount of the developer-tank-contained developer 3 inside the developer tank 66 is substantially equal to the discharge amount, and the filling amount is the amount obtained when the developer-tank-contained developer 3 fills the inside of the developer tank 66 to the level of the flow outlet 75.

In the developing device 34 according to the present invention shown in FIGS. 4 and 5, since the initial filling amount of the developer-tank-contained developer 3 is less than the full filling amount, an accommodating space having a capacity amounting to the difference obtained by subtracting the initial filling amount from the full filling amount is formed in the developer tank 66. Even if the toner concentration is lowered and the replenishing operation for replenishing the replenishment developer 2 is carried out so that the lowered toner concentration is restored to the reference toner concentration, the accommodating space can accommodate the replenished replenishment developer 2, whereby the fresh carrier contained in the replenishment developer 2 is not discharged immediately. Hence, as shown in FIG. 4, the state in which the discharge amount of the carrier is zero is maintained until the state of full filling is reached.

On the other hand, in the developing device 34 according to the comparison example shown in FIGS. 4 and 5, since the initial filling amount of the developer-tank-contained developer 3 is equal to the full filling amount, no accommodating space is formed in the developer tank 66; if the replenishing operation is carried out in a way similar to that described above, the developer-tank-contained developer 3 is discharged from the developer tank 66 by the amount of the replenished amount. Since the discharged developer-tank-contained developer 3 contains unused carrier, the discharge amount of the carrier increases with the elapse of time as shown in FIG. 4.

Furthermore, as shown in FIG. 5, in view of the total amount of the carrier contained in the replenishment developer 2 that is discharged when image forming operation for 3000 sheets for example was carried out after the full filling state and in the case of the present invention in which the relationship of the initial filling amount<the full filling amount is satisfied, since the fresh replenishment developer 2 is accommodated in the above-mentioned accommodating space, the total discharge amount of the carrier contained in the replenishment developer 2 is zero until the state of full filling is reached. However, after the full filling state, almost unused carrier begins to be discharged (the total discharge amount of the carrier when image forming operation for 3000 sheets was carried out is assumed to be $\beta$). On the other hand, in the case of the comparison example in which the relationship of the initial filling amount=the full filling amount is satisfied, since the above-mentioned accommodating space does not exist, the amount of the developer-tank-contained developer 3 corresponding to the replenishing amount of the replenishment developer 2 is discharged immediately, and the discharge amount of almost unused carrier increases with the elapse of time (the total discharge amount of the carrier when image forming operation for 3000 sheets was carried out is assumed to be $\alpha$). When it is assumed that the total discharge amounts of the carrier in the present invention and the comparison example are assumed to be $\beta$ and $\alpha$, respectively, a relationship of $\beta<\alpha$ is established.

Hence, with the very simple configuration of the present invention, almost unused carrier that is not yet deteriorated can be prevented from being discharged immediately, and the fresh carrier contained in the replenishment developer 2 can be prevented from being discharged without being used.

The initial filling operation for initially filling the developer-tank-contained developer 3 into the developer tank 66 may be carried out such that the operation has already been done at the time when the image forming apparatus 1 is shipped from the factory that produced it, or the operation may be carried out at the time when the image forming apparatus 1 is installed at the user's site.

Furthermore, the developing device 34 eventually reaches the full filling state by operating the image forming apparatus 1. In order to further reduce the discharge amount of the carrier when the discharge operation is carried out after the full filling state is reached, it is preferable that the amount of the carrier contained in the initial developer-tank-contained developer 3 should be set so as to be less than the amount of the carrier contained in the developer-tank-contained developer 3 at the time of the full filling state.

Next, a modified embodiment of the present invention will be described.

When the image forming operation is carried out, the toner existing inside the developer tank 66 is consumed, and the toner concentration inside the developer tank 66 becomes lower gradually. As the toner is consumed, a predetermined amount of toner is replenished from the developer replenishing tank 80 and the replenishment of the carrier is also carried out, accompanied by the replenishment of the toner. Since the amount of the carrier contained in the fresh replenishment developer 2 is added to the initial filling amount of the carrier having been filled in advance, the amount of the carrier existing inside the developer tank 66 increases. Hence, there is a possibility that the carrier contained in the fresh replenishment developer 2 is discharged without being used. In addition, in an initial stage in which not a long time has passed after the developing device 34 was operated, the carrier is not deteriorated so much, and it is not necessary to replace a large amount of the carrier. In order to avoid the carrier contained in the fresh replenishment developer 2 from being discharged without being used, it is preferable that the ratio of the carrier contained in the replenishment developer 2 that is filled first time into the developer replenishing tank 80 is set so as to be lower than the ratio of the carrier contained in the replenishment developer 2 that is filled after the first time (that is, the second time, third time, . . . ).

As described above, in the initial stage and an ordinary operation stage in which ordinary image forming operation is carried out after a certain time has passed after the initial stage, multiple kinds of the developer replenishing tank 80, being different in the ratio of the carrier contained in the replenishment developer 2, are used occasionally. However, in the case that such multiple kinds of the developer replenishing tank 80, being different in the ratio of the carrier, are used, there is a possibility that a developer replenishing tank 80 different from the developer replenishing tank 80 that should be mounted essentially is mounted on the developing device 34 by mistake while the operation stage is shifted between the initial stage and the ordinary operation stage, whereby it is necessary to prevent the developer replenishing tank 80 from being mounted improperly. In order that the device can judge what ratio of the carrier the developer replenishing tank 80 to be mounted has, it is preferable that the developer replenishing tank 80 is equipped with an information storage memory 81 that stores information regarding the ratio of the carrier contained in the replenishment developer 2 filled in the developer replenishing tank 80.

Figure 6:
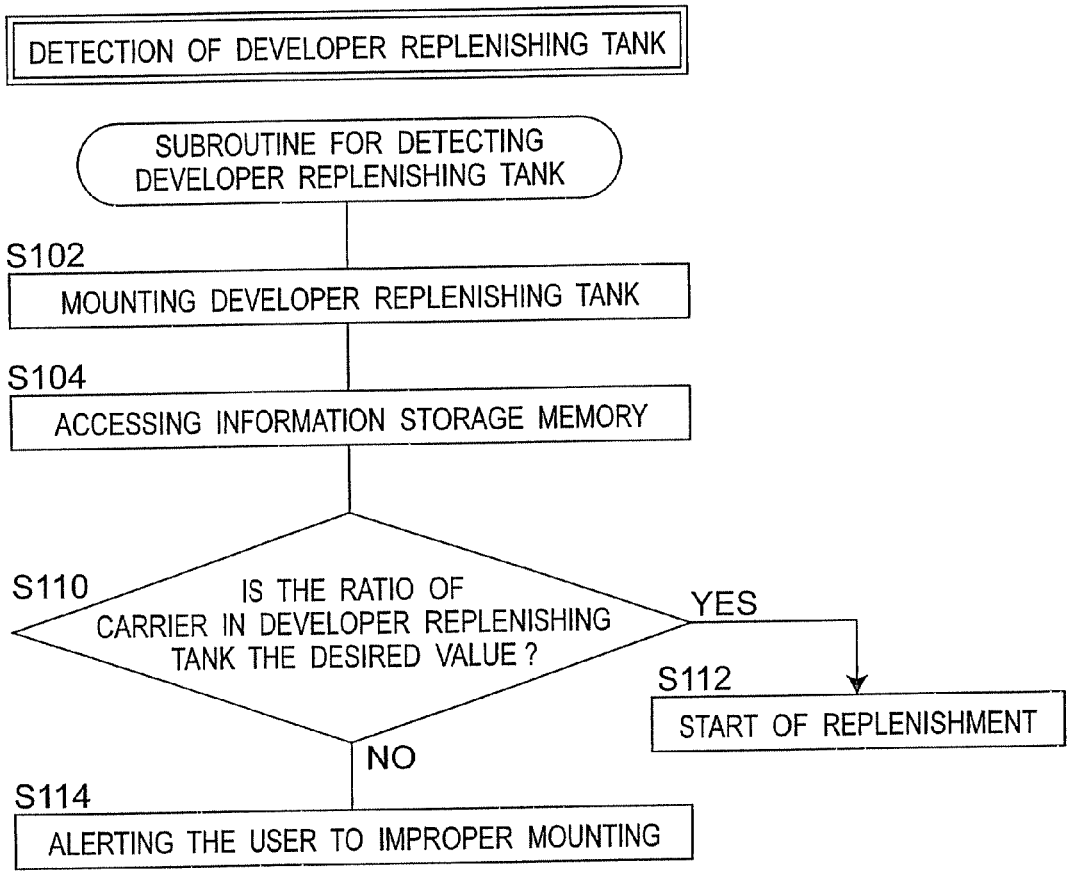
FIG. 6 is a flowchart illustrating a subroutine regarding the detection of a developer replenishing tank according to the present invention.

How to prevent improper mounting of the developer replenishing tank 80 will be described referring to FIG. 6. FIG. 6 is a flowchart illustrating a subroutine regarding the detection of the developer replenishing tank 80 according to the present invention.

At step S102, the developer replenishing tank 80 filled with the replenishment developer 2 at a predetermined ratio of the carrier and equipped with the information storage memory 81 in which the information regarding the ratio of the carrier is stored is mounted on the developing device 34. At step S104, the CPU 102 of the controller 100 accesses the information storage memory 81, and the information regarding the ratio of the carrier stored in the information storage memory 81 is read by the CPU 102 of the controller 100 via the reading interface. At step S110, the CPU 102 of the controller 100 judges whether the mounted developer replenishing tank 80 is the developer replenishing tank 80 that is filled at a predetermined ratio of the carrier.

When it is judged at step S110 that the mounted developer replenishing tank 80 is the developer replenishing tank 80 that is filled at the predetermined ratio of the carrier, the developer supplying roller is driven and rotated at step S112, whereby the replenishment developer 2 is replenished from the mounted developer replenishing tank 80.

When it is judged at step S110 that the mounted developer replenishing tank 80 is not the developer replenishing tank 80 that is filled at the predetermined ratio of the carrier, the user is alerted to improper mounting of the developer replenishing tank 80 at step S114 by generating sound or artificial voice to call attention from a buzzer or speaker or by displaying messages to call attention on a display provided for the image forming apparatus 1. Additionally or alternatively, it is possible to lock the rotation and driving of the developer supplying roller so that the replenishing operation of the replenishment developer 2 is not carried out. Furthermore, when the fact that the mounted developer replenishing tank 80 that is filled at an undesired ratio of the carrier has been replaced with another developer replenishing tank 80 that is filled at the desired ratio of the carrier is confirmed by the CPU 102 of the controller 100, the replenishing operation for the replenishment developer 2 is carried out.

Furthermore, although the present invention is defined in claims using an upper limit value that the initial filling amount being less than the full filling amount can take, the initial filling amount cannot be decreased indefinitely. The lower limit value the initial filling amount can take is just prior to the limit filling amount at which improper image formation, such as uneven image concentration, occurs because of the shortage of the developer-tank-contained developer; however, since the lower limit value is a value indispensable to properly carry out image forming operation and since proper image formation cannot be performed if the amount is less than the lower limit value, the lower limit value is just not defined particularly. Hence, the initial filling amount is set so as to be larger than the above-mentioned limit filling amount.

What is claimed is:

1. A developing device having stirring members for stirring a developer-tank-contained developer containing toner and carrier while conveying the developer along conveying passages inside a developer tank and a developer holder disposed adjacent to said stirring members to supply the stirred developer-tank-contained developer to an electrostatic latent image holder, comprising:

a developer replenishing tank for replenishing a replenishment developer containing toner and carrier to said developer tank, and a discharging mechanism for discharging an excessive amount of the developer-tank-contained developer outside said developer tank from a discharge opening section when the amount of the developer-tank-contained developer to be conveyed using said stirring members inside said developer tank exceeds a predetermined full filling amount, wherein the initial filling amount of the developer-tank-contained developer to be filled initially into said developer tank is set so as to be less than said full filling amount.

2. The developing device according to claim 1, wherein the amount of the carrier initially contained in the developer-tank-contained developer is less than the amount of the carrier contained in the developer-tank-contained developer at the time of full filling.

3. The developing device according to claim 1, wherein said initial filling amount is larger than an amount just prior to the limit filling amount at which improper image formation occurs because of the shortage of the developer-tank-contained developer.

4. The developing device according to claim 1, wherein the ratio of the carrier contained in the replenishment developer that is filled first time into said developer replenishing tank is set so as to be lower than the ratio of the carrier contained in the replenishment developer that is filled after the first time.

5. The developing device according to claim 1, wherein said developer replenishing tank is configured so as to be attachable and detachable to and from said developing device and is equipped with an information storage medium that stores information regarding the ratio of the carrier contained in the replenishment developer filled in said developer replenishing tank.

6. An image forming apparatus comprising:

a rotatable electrostatic latent image holder for holding electrostatic latent images on the circumferential face thereof, a developing device having stirring members for stirring a developer-tank-contained developer containing toner and carrier while conveying the developer along conveying passages inside a developer tank and a developer holder disposed adjacent to said stirring members to supply the stirred developer-tank-contained developer to said electrostatic latent image holder, said image forming apparatus further comprising:

a developer replenishing tank for replenishing a replenishment developer containing toner and carrier to said developer tank, and a discharging mechanism for discharging an excessive amount of the developer-tank-contained developer outside said developer tank from a discharge opening section when the amount of the developer-tank-contained developer to be conveyed using said stirring members inside said developer tank exceeds a predetermined full filling amount, wherein the initial filling amount of the developer-tank-contained developer to be filled initially into said developer tank is set so as to be less than said full filling amount.

7. The image forming apparatus according to claim 6, wherein the amount of the carrier initially contained in the developer-tank-contained developer is less than the amount of the carrier contained in the developer-tank-contained developer at the time of full filling.

8. The image forming apparatus according to claim 6, wherein said initial filling amount is larger than an amount just prior to the limit filling amount at which improper image formation occurs because of the shortage of the developer-tank-contained developer.

9. The image forming apparatus according to claim 6, wherein the ratio of the carrier contained in the replenishment developer that is filled first time into said developer replenishing tank is set so as to be lower than the ratio of the carrier contained in the replenishment developer that is filled after the first time.

10. The image forming apparatus according to claim 6, wherein said developer replenishing tank is configured so as to be attachable and detachable to and from said developing device and is equipped with an information storage medium that stores information regarding the ratio of the carrier contained in the replenishment developer filled in said developer replenishing tank.

11. A method for filling developer into the developer tank of a developing device comprising stirring members for stirring a developer-tank-contained developer containing toner and carrier while conveying the developer along conveying passages inside a developer tank, a developer holder disposed adjacent to said stirring members to supply the stirred developer-tank-contained developer to an electrostatic latent image holder, a developer replenishing tank for replenishing a replenishment developer containing toner and carrier to said developer tank, and a discharging mechanism for discharging an excessive amount of the developer-tank-contained developer outside said developer tank from a discharge opening section when the amount of the developer-tank-contained developer to be conveyed using said stirring members inside said developer tank exceeds a predetermined full filling amount, wherein the initial filling amount of the developer-tank-contained developer to be filled initially into said developer tank is set so as to be less than said full filling amount.

* * * * *